US011097159B2

(12) United States Patent
Boncelj

(10) Patent No.: US 11,097,159 B2
(45) Date of Patent: Aug. 24, 2021

(54) DEVICE FOR GENERAL AND SPORTS PHYSIOTHERAPY AND ITS USE

(71) Applicant: Jože Boncelj, Cerklje na Gorenjskem (SI)

(72) Inventor: Jože Boncelj, Cerklje na Gorenjskem (SI)

( * ) Notice: Subject to any disclaimer, the term of this patent is extended or adjusted under 35 U.S.C. 154(b) by 1115 days.

(21) Appl. No.: 14/890,356

(22) PCT Filed: May 11, 2013

(86) PCT No.: PCT/IB2013/053834

§ 371 (c)(1),
(2) Date: Nov. 10, 2015

(87) PCT Pub. No.: WO2014/184609

PCT Pub. Date: Nov. 20, 2014

(65) Prior Publication Data

US 2016/0121167 A1 May 5, 2016

(51) Int. Cl.
*A63B 24/00* (2006.01)
*A61H 1/02* (2006.01)
(Continued)

(52) U.S. Cl.
CPC ..... *A63B 24/0087* (2013.01); *A61H 1/02* (2013.01); *A61H 1/0218* (2013.01);
(Continued)

(58) Field of Classification Search
CPC ..... A63B 24/0087; A63B 21/00178; A63B 21/00181; A63B 23/03525; A63B 21/068;
(Continued)

(56) References Cited

U.S. PATENT DOCUMENTS 3,741,200 A 6/1973 Morin
4,103,681 A 8/1978 Shanley
(Continued)

FOREIGN PATENT DOCUMENTS

DE 25 59 309 A1 5/1977
EP 2 329 863 A1 6/2011
(Continued)

OTHER PUBLICATIONS

International Search Report dated Nov. 28, 2013 from corresponding International Patent Application No. PCT/IB2013/053834; 5pgs.
(Continued)

*Primary Examiner* — Sundhara M Ganesan
(74) *Attorney, Agent, or Firm* — Anthony D. Pellegrini

(57) ABSTRACT

A device for general and sport physiotherapy, facilitating the performance of stretching and relaxation exercises on the muscles of the entire body. One innovative aspect of this device lies in the configuration of its guidance mechanism, the configuration of the mechanism for regulating the device's height, the configuration of the mechanism facilitating the rotation of the transverse carrier bar with its self-locking rotatable coupling around the axle of the transverse carrier bar, and in the configuration of the device as a whole, which provides the user with the choice of a new range of prophylactic and preventive health care exercises and appropriate therapies. The patent request at hand is being lodged for both the manual as well as the electronic operation mechanism of the device.

11 Claims, 11 Drawing Sheets

(51) Int. Cl.

| | |
|---|---|
| ***A63B 21/02*** | (2006.01) |
| ***A63B 21/00*** | (2006.01) |
| *A63B 23/035* | (2006.01) |
| *A63B 23/04* | (2006.01) |
| *A63B 22/00* | (2006.01) |
| *A63B 21/068* | (2006.01) |

(52) U.S. Cl.
CPC ..... *A61H 1/0229* (2013.01); *A61H 1/0292* (2013.01); *A63B 21/00178* (2013.01); *A61H 2201/1215* (2013.01); *A61H 2201/1635* (2013.01); *A61H 2201/1642* (2013.01); *A61H 2203/0493* (2013.01); *A63B 21/00181* (2013.01); *A63B 21/023* (2013.01); *A63B 21/068* (2013.01); *A63B 23/03525* (2013.01); *A63B 23/0405* (2013.01); *A63B 2022/0084* (2013.01)

(58) Field of Classification Search
CPC ..... A63B 21/023; A63B 2022/0084; A63B 23/0405; A61H 1/02; A61H 1/0292; A61H 1/0229; A61H 1/0218; A61H 2201/1635; A61H 2201/1215; A61H 2203/0493; A61H 2201/1642
See application file for complete search history.

(56) References Cited

U.S. PATENT DOCUMENTS

| | | | | |
|---|---|---|---|---|
| 2011/0152032 | A1 | 6/2011 | Barnett | |
| 2018/0169456 | A1* | 6/2018 | Rachele ..... | A61B 5/6895 |

FOREIGN PATENT DOCUMENTS

| | | | |
|---|---|---|---|
| GB | 2 152 381 | A | 8/1985 |
| JP | 2001 204768 | A | 7/2001 |
| WO | 02094387 | A1 | 11/2002 |

OTHER PUBLICATIONS

"Analysis of the fulfillment of the criteria of inventiveness for the Device for General and Sports Physiotherapy and its Application".

* cited by examiner

DEVICE FOR GENERAL AND SPORTS PHYSIOTHERAPY AND ITS USE

BACKGROUND AND SUMMARY OF THE INVENTION

The invention is an device for general and sport physiotherapy, which facilitates the application of new preventative methods in the fields of prophylactic health care and preventive medicine as well as rehabilitation following injury and illness. According to the International Patent Classification scheme, this device falls into the category A61H 1/02—Stretching or bending device for exercising, or into the category A63B 23/00—Exercising device specially adapted for particular parts of the body.

A considerable number of specialized devices have already been developed for use in the field of physiotherapy. The main aim of this invention, however, is not to figure as an upgrade of these devices, but to provide new means of exercising individual parts of the body and the whole body. A comparable devices in this classification category can be found under the registered patent KR 20120044806 (A)—2012 May 8, which, however, does not feature all the different methods of use that this invention provides.

The innovative aspect of this device for general and sport physiotherapy lies in the fact that it can be adapted to the requirements of each individual user and the exercises they need to do, as well as in the fact that unlike the majority of all other such equipment this device can be used by several people at the same time.

The device for general and sport physiotherapy is designed for use in various environments, such as health care facilities, sports centres, schools and in the home. It is suitable for use in alleviating the harmful effects of overexertion in all forms of sports whether competitive or recreational, or for rehabilitation following injury or illness. The device is designed for professional use, but also suitable for use in the home. The device can be used by all the family members at the same time and in addition to its use as a physiotherapy aid, it also has a positive effect on the users' wellbeing and promotes a feeling of connectedness between them.

The invention stands as a complement to the range of devices aimed at increasing personal health and strength. These devices usually target a specific set of muscles or muscle group and strengthen it by means of certain forms of movement. The growing popularity of such exercise routines has brought about numerous positive effects on the personal strength, health and wellbeing of individuals. However, using incorrect exercise techniques or overdoing one's workouts can also have negative effects. Muscle pain, sore joints and aching bones can also be a result of work-related activities or illness. These negative effects can be alleviated or even eliminated entirely by means of exercises that result in the stretching and relaxation of the muscles, ligaments and joints of the entire body such as can be done using this device.

The individual components of said device for general and sport physiotherapy are already known mechanisms, which have been adapted for use as its components. The innovative aspect of this device lies in the configuration of its guidance mechanism, the configuration of the mechanism for regulating the device's height, the configuration of the mechanism for the transverse carrier bar, the configuration of the device as a whole and the user's guide, providing the user with the choice of a whole range of diverse exercises with the option of gradually increasing the intensity of the exercise regimen in order to protect his/her health and to best implement the most appropriate therapy.

DETAILED DESCRIPTION OF THE INVENTION

Figure 1:
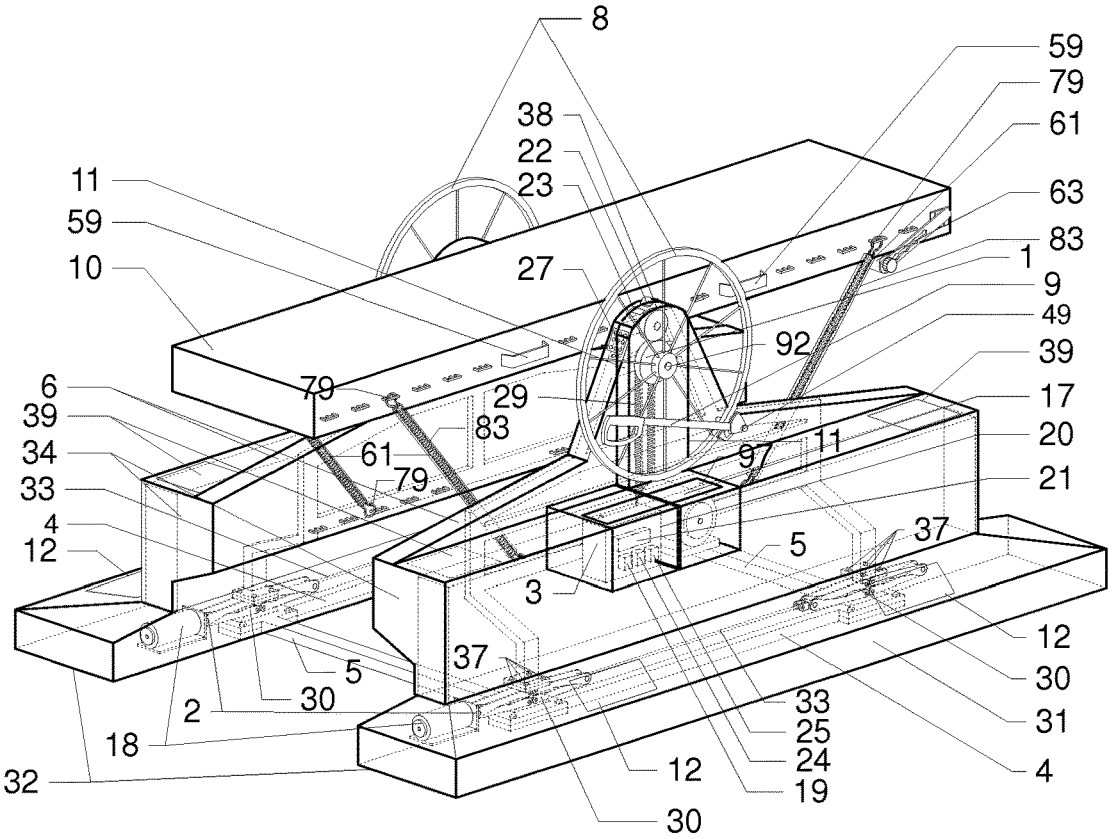
FIG. 1 depicts the device in the lowest possible position with regard to the height settings, along with a presentation of the parts of the device.

FIG. 1 depicts the device in the lowest possible position with regard to the height settings, along with a presentation of the parts of the device. The device for general and sports physiotherapy comprising: the driving mechanism of the device (1), said driving mechanism being situated in the upper left and right parts of the frame of the device (6), a mechanism for raising and lowering said device (2), said mechanism being situated in the lower left and right section of the supporting frame (4), and electrical and electronic equipment (3), wherein said equipment is built into mechanism (1) and (2). The electrical and electronic equipment as claimed in claim 1, functions according to the electrical plan as depicted in (28). Further, the device for general and sport physiotherapy as claimed in claim 1 is also comprised of a left and right part of the frame (4) with a transverse support connecting the lower, supporting part of said frame (5), an upper left and right part of the frame (6), an axle (7), a control device on the left and the right side of the device (8), a lever for blocking the device (9) said lever being located on one side of the device, and a body supporting panel (10), said panel being secured by padded springs (61).

Electric and electronic equipment (3) provides operation of the device driving mechanism (1) and operation of the mechanism for lifting and lowering of the device (2). The device comprises three reduction units. The worm reduction unit with clutch and an asynchronous belt-driven (17) electric brake motor (possibility to release the brake in idle position). The number of revolutions of the worm reduction unit (17) can be changed by means of a frequency regulator (19). The mechanism for lifting and lowering of the device (2) has two identical reduction worm gear units with limit switches (18). The electric and electronic equipment (3) comprises a control cubicle (20), modem for electronic control of the device (21), emergency stop button (22), cut-out (24), contactors (25), electric supply (26), switch for two identical reduction units with limit switches on top of the device support structure (23) and electronic transmitter (27) on top of the device support structure (38). The electric and electronic equipment (3) operates according to a single-pole wiring diagram (28).

The electric and electronic equipment (3) can be operated by means of an integrated electronic transmitter (27) on top of the device supporting structure (38). During the entire exercise period the user will be able to steer the device in the desired direction, stop it and change the direction of bed movement. Alternatively, the device can be controlled with the electronic transmitter (27) by a physical therapist or other eligible person of legal age.

The electric and electronic equipment (3) in the event that the device is electrically and electronically controlled, the electric drive is provided only on one side of the device.

The lower left and right part of the frame (4) regulates the device height. The device height needs to be adjusted in relation to the user's height and the respective application of the device. For this purpose a mechanism for lifting and lowering of the device (2) is provided in this part of the frame which comprises four electric jacks (30) and two identical reduction worm gear units with limit switches (18) which allows electric lifting and lowering of the device. The bottom left and right frame part (4) is provided with a device part storage compartment (31) with the corresponding door (82). The said compartment is used to store padded springs (61), safety belts (62), a pillow (65), a self-locking coupling piece (76), hand braces (64) and ankle braces (80). The bottom left and right frame parts (4) are also designed for the step (12) provided to mount the device bed (10).

The bottom left and right frame parts (4) are provided with a transverse connection between left and right part of the lower part of the frame (5). This connection (5) provides the device stability and enables electric connection between left and right part of the lower frame part (4). The left and right frame parts are identical. It comprises the housing (32) with two electric jacks (30) attached to its bottom surface on left and right side. Both electric jacks (30) are interconnected by a common axle (33). The cladding of the upper part of the frame (34) is covered by the housing of the frame's lower part (32) up to the step of the frame's lower part (12). The device moved upwards and downwards by means of electric jacks (30).

Both parts of the lower left and right frame part (4) are interconnected with the same switch (23) on top of the device frame (38) by means of which the device is simultaneously lifted or lowered on both sides.

The lower left and right frame part (4) and the upper left and right frame part (6) are screwed on four points on top of electric jacks (37). Electric jacks (30) are attached to the lower surface of the lower left and right frame part (4) with screws (36).

The upper left and right frame part (6) are identical and connected with the device axle (7). The upper left and right frame part (6) can be used as step (39) to safely mount and dismount the device.

The axle of the device (7) is built in the upper left-hand and right-hand parts of the framework (6) by means of a small cogwheel (14) on the left-hand and the right-hand sides of the device. The axle of the device (7) links the upper left-hand and the right-hand parts of the framework (6) so as to ensure the stability of the device. The axle of the device (7) is in a ball-bearing housing (13). The ball-bearing housing (13) is fastened into the upper part of the left-hand and the right-hand parts of the framework (6) with screws (40) on the lower side of the ball-bearing housing (13). The two ball-bearing housings (13) are covered by the top of the device framework (38) on the upper side and on the sides of the two ball-bearing housings (13). The top of the device framework is screwed into the upper left-hand and the right-hand parts of the framework (6) by means of screws (40).

Rudders on the left-hand and the right-hand sides of the device (8) are on the same axle (88) as a big cogwheel (15). The rudder is required for manual adjustment of the inclination angle of the bed of the device (10) and for returning the bed to the position for exiting the device. When the user pulls towards him/her the rudder of the device (8) on the left-hand and the right-hand sides of the device, the bed is turning in the opposite direction. If the device of the user is without electrical and electronic equipment (3) or when the device is idling (no load), the rudders on the left-hand and the right-hand sides of the device (8) are the essential components of the device for changing the movement direction of the bed of the device (10).

Springs (61) are used for the purpose of the user's safety when the device for general and sports physiotherapy is in the lowest position during the user's rocking movements on the bed. The springs are protected with the coating (83); they are attached to U clamps (60) with carabiners (79). By inserting the springs (61) into different U clamps (60) on the edge of the bed of the device (10) and into the inner edge of the upper left-hand and the right-hand parts of the framework (6), the springs are extended or compressed whereby their force is adjusted (61). The springs are useful also when the user manually changes the inclination angle of the bed. In this case, the springs (61) retain the bed of the device (10), preventing it from hitting the floor.

Figure 2:
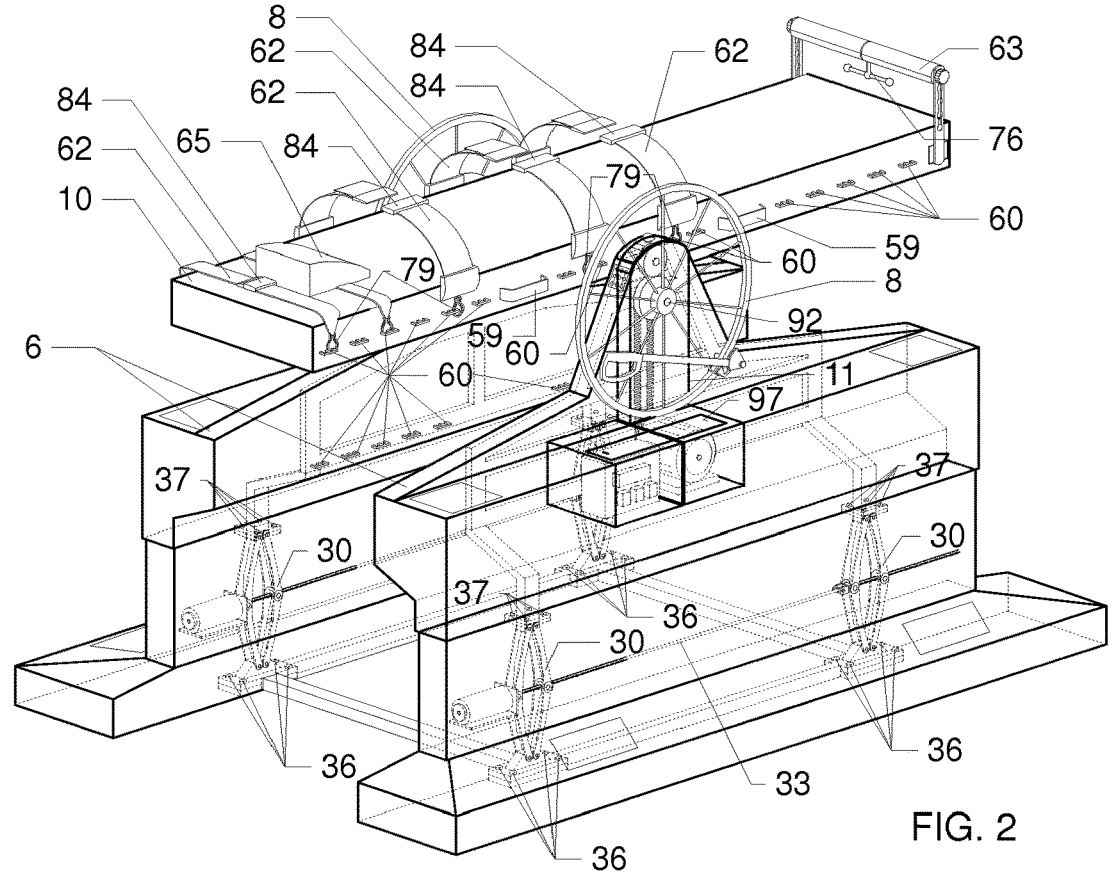
FIG. 2 depicts the device in the highest possible position with regard to the height settings, with raised lower supporting frame, along with a presentation of the parts of the apparatus that must be engaged for the device to work safely at this setting.

FIG. 2 depicts the device in the highest possible position with regard to the height settings, with raised lower supporting frame, along with a presentation of the parts of the apparatus that must be engaged for the device to work safely at this setting. The top side of the bed of the device (53) is upholstered and glued onto the upper and side frames of the second part of the framework (55) and the third part of the framework (56) and onto the bottom side of the bed of the device (52). Two handles for hands (59) and U clamps (60) are screwed on the edge of the second part of the framework (55) and the third part of the framework (56) of the bed; they are used for attaching coated springs (61) and safety belts (62).

The bottom side of the bed (52) is used mostly for the performance of muscle-strengthening exercises. A transversal bar (63), safety belts (62) and grips for hands (64) can be used on the bottom side of the bed (52) or on the top side of the bed (53). The user may also install a head-rest (65) onto the bed of the device (10).

Safety belts (62) are used when the bed of the device (10) rotates around its axis. Since they bear the weight of the body, they are wider than other safety belts. Carabiners (79) are used for attaching the safety belts onto the device. The already tested safety belt securing buckles (84) are used for tightening the safety belts (62). The safety belts (62) do not require patent protection. The user can fasten the safety belts (62) either transversely or crosswise on the bed of the device (10). The safety belts (62) can also be used for hand grip or leg support.

Figure 3:
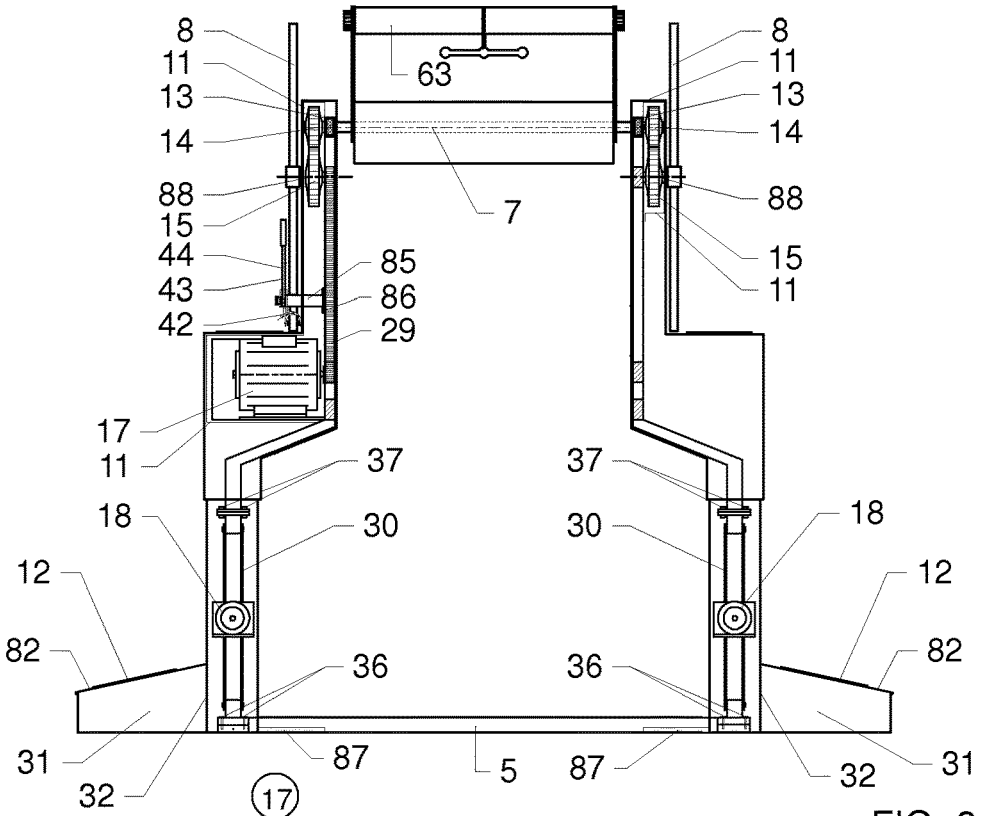
FIG. 3 depicts a frontal cross-section view of the device's driving mechanism with its worm reduction gear and belt drive, as well as the mechanism for raising and lowering the device.

FIG. 3 depicts a frontal cross-section view of the device's driving mechanism with its worm reduction gear and belt drive, as well as the mechanism for raising and lowering the device. Device driving mechanism (1) has the housing (11) comprises the following mechanical parts: the axle of the device (7), ball bearing housing (13), small cogwheel (14) on the device's axle (7), large cogwheel (15), a worm reduction unit with clutch and an asynchronous brake motor (possibility to release the brake in idle position) with belt drive (17), large cogwheel (15) with the same axle (88) and the steering mechanism of the device provided on left and right side of the device (8).

Device driving mechanism (1) with the worm reduction unit with clutch and belt-driven (17) asynchronous electric brake motor provides manual operation of the device when idling. In this event the user must control the device with the steering mechanism on left and right side of the device (8), provided on the same axle (88) with the large cogwheel (15), the said being intertwined with the small cogwheel (14) positioned on the device axle (7). The device steering (8), the small (14) and the large cogwheel (15) are provided on both sides of the device.

The device driving mechanism (1) with the worm reduction unit provided with asynchronous electric brake motor with clutch (17), connected via the belt (29) to the large cogwheel (15) while the device is operated by means of electric and electronic equipment (3) and during manual operation. Through the use of a belt (29) optimal distance between wings (8) and optimal bed width (10) is achieved in this device type. This device driving mechanism (1) allows the execution of all foreseen activities on the device.

Figure 4:
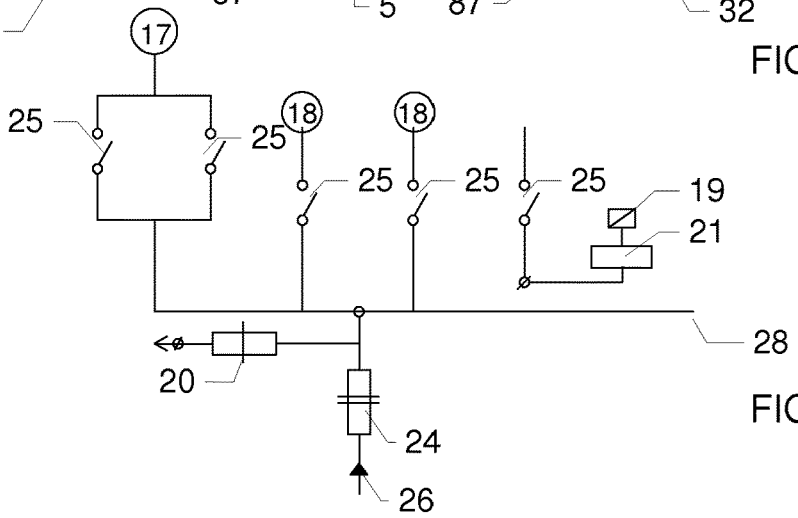
FIG. 4 depicts the schematics of the device's electronics.

FIG. 4 depicts the schematics of the device's electronics. Electric and electronic equipment (3) is indicated in [0031], [0032] and [0033] and is shown in FIG. 1, FIG. 2, FIG. 3 and FIG. 6.

Figure 5:
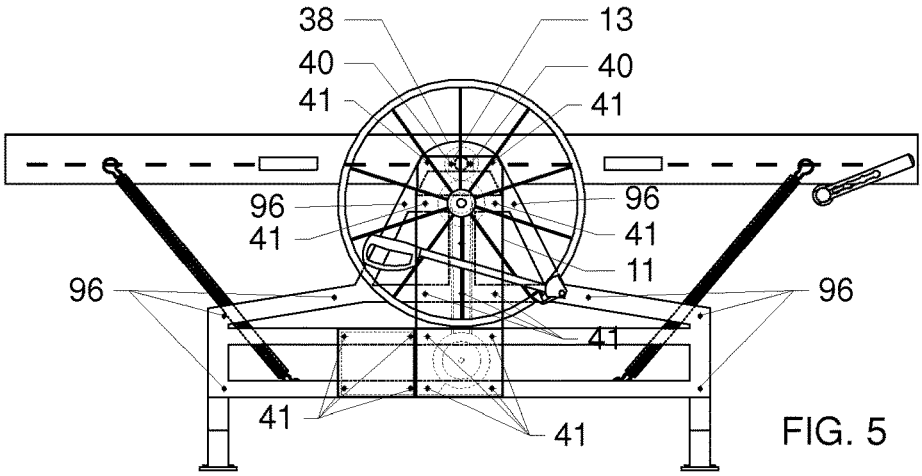
FIG. 5 depicts the housing of the device's driving mechanism and the control box, screwed to the upper part of the frame.

FIG. 5 depicts the housing of the device's driving mechanism and the control box, screwed to the upper part of the frame. A housing of the drive mechanism of the device (11) is built into the upper left-hand and the right-hand parts of the framework (6). The housing of the drive mechanism of the device (11) is screwed by means of screws (41) on both sides of the upper left-hand and the right-hand parts of the framework (6) and is a component of the upper part of the framework. The upper part of the framework (6) and the housing of the drive mechanism of the device (11) are covered by a casing of the upper part of the framework (34) made of aluminium and plastic. The door (97) of the control box and of the housing of the drive mechanism of the device is a component of the casing of the upper part of the framework (34) and enables access to the vital parts of the device.

Figure 6:
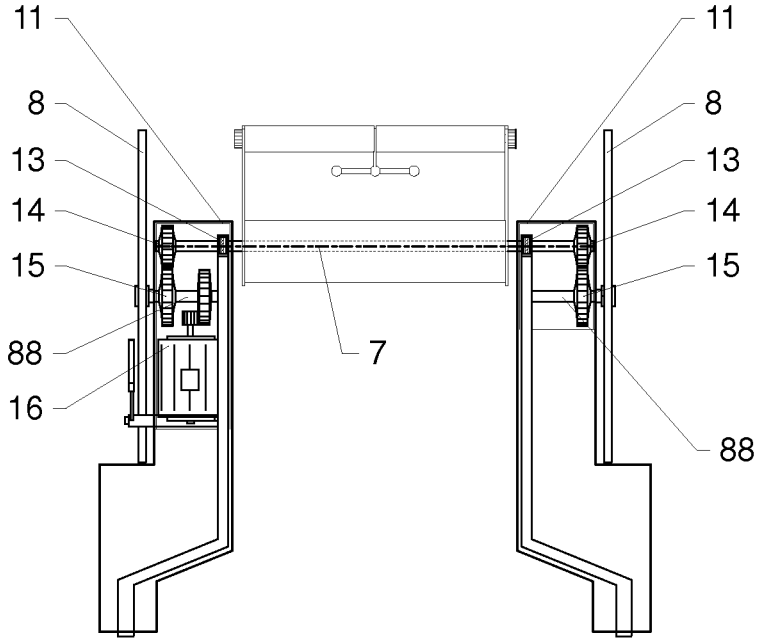
FIG. 6 depicts frontal cross-section view of the device driving mechanism with its worm reduction gear as one of the driving mechanisms depicted for the device.

FIG. 6 depicts frontal cross-section view of the device driving mechanism with its worm reduction gear as one of the driving mechanisms depicted for the device.

Figure 7:
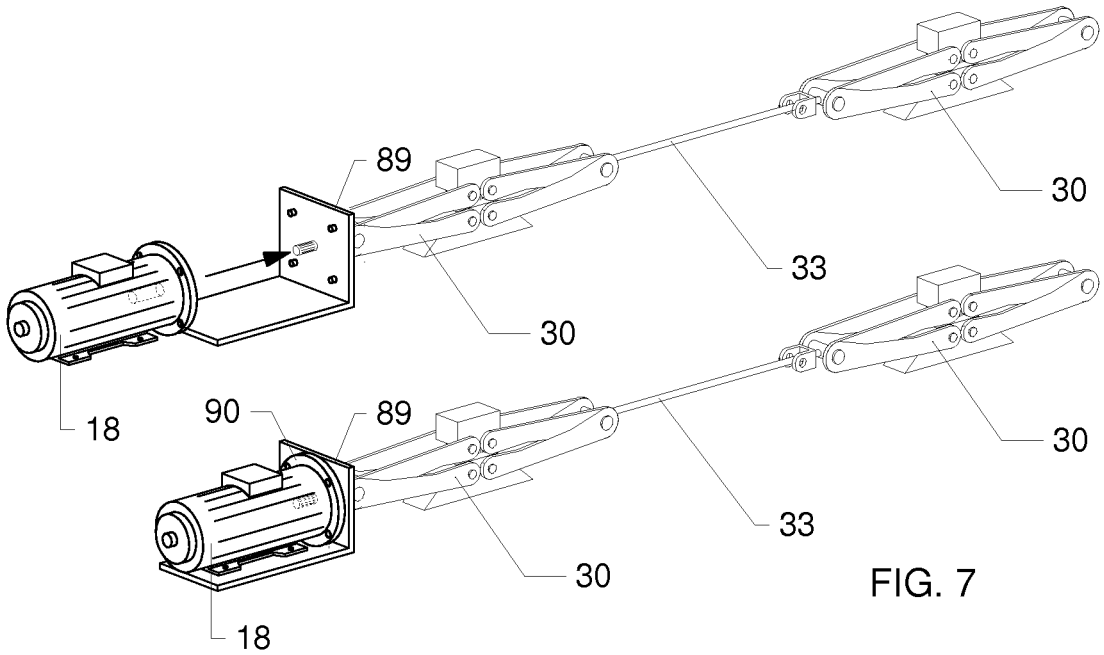
FIG. 7 depicts the mechanism for raising and lowering the device, two reduction gears and four electric jacks.

FIG. 7 depicts the mechanism for raising and lowering the device, two reduction gears and four electric jacks (30). The first two electric jacks (30) on the left and right side of the frame's lower part (4) is lifted and lowered by both said elements. Both said elements are joined by means of two identical reduction worm gear units with limit switches (18). The interconnection of two electric jacks with the common axle (33) to which a reduction worm gear unit with limit switches is attached (18), and interconnection of left and right side with the same switch for two identical worm reduction units (23) is an invention which extends the scope of possible activities that can be performed on the device and its safer use.

The first two electric jacks (30) on left and right side of the lower left and right frame part (4) with both reduction worm gear units with limit switches for lifting and lowering of the device (18) can be connected to an electronic transmitter (27) and modem for electronic device control (21), or only electrically with a switch (23) on top of the upper right device frame part (38).

The first two electric jacks (30) on left and right side of the lower left and right frame part (4) are interconnected with the reduction worm gear unit with limit switches designed for lifting and lowering of the device (18), and the common axle (33) of two electric jacks (30). Common axle (33) of two electric jacks (30) provides synchronous and uniform lifting and lowering of the device. The first two electric jacks (30) can be connected to electrical power supply or accumulator with inverter.

Figure 8:
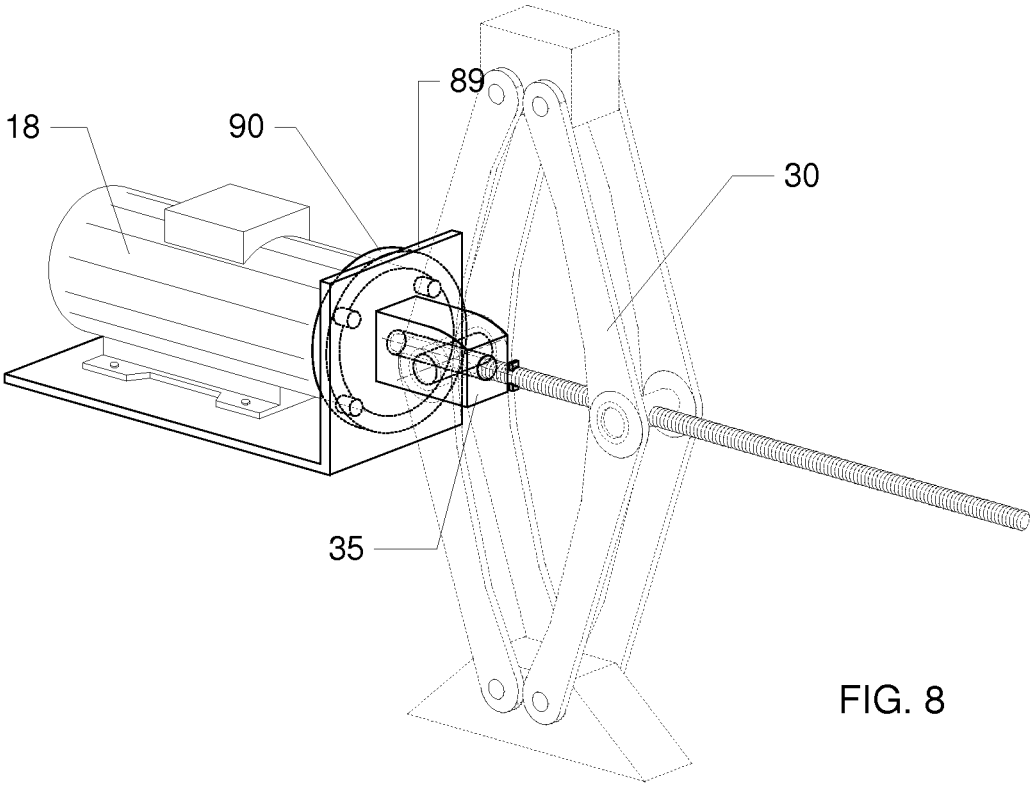
FIG. 8 depicts the part of the device which is built into the electric jack, which is the reduction gear carrier and which connects the electric jack with the reduction gear.

FIG. 8 depicts the part of the device which is built into the electric jack, which is the reduction gear carrier and which connects the electric jack with the reduction gear. The first two electric jacks (30) on the left and right side of the lower frame part (4) have a flange (89) for lifting the device has been manufactured which is joined with an additional part in the electric jack (35) functioning as support for the reduction unit. This flange (89) is screwed to the flange (90) to which the reduction worm gear unit with limit switches (18) is attached which enables lifting and lowering of electric jacks (30).

Figure 9:
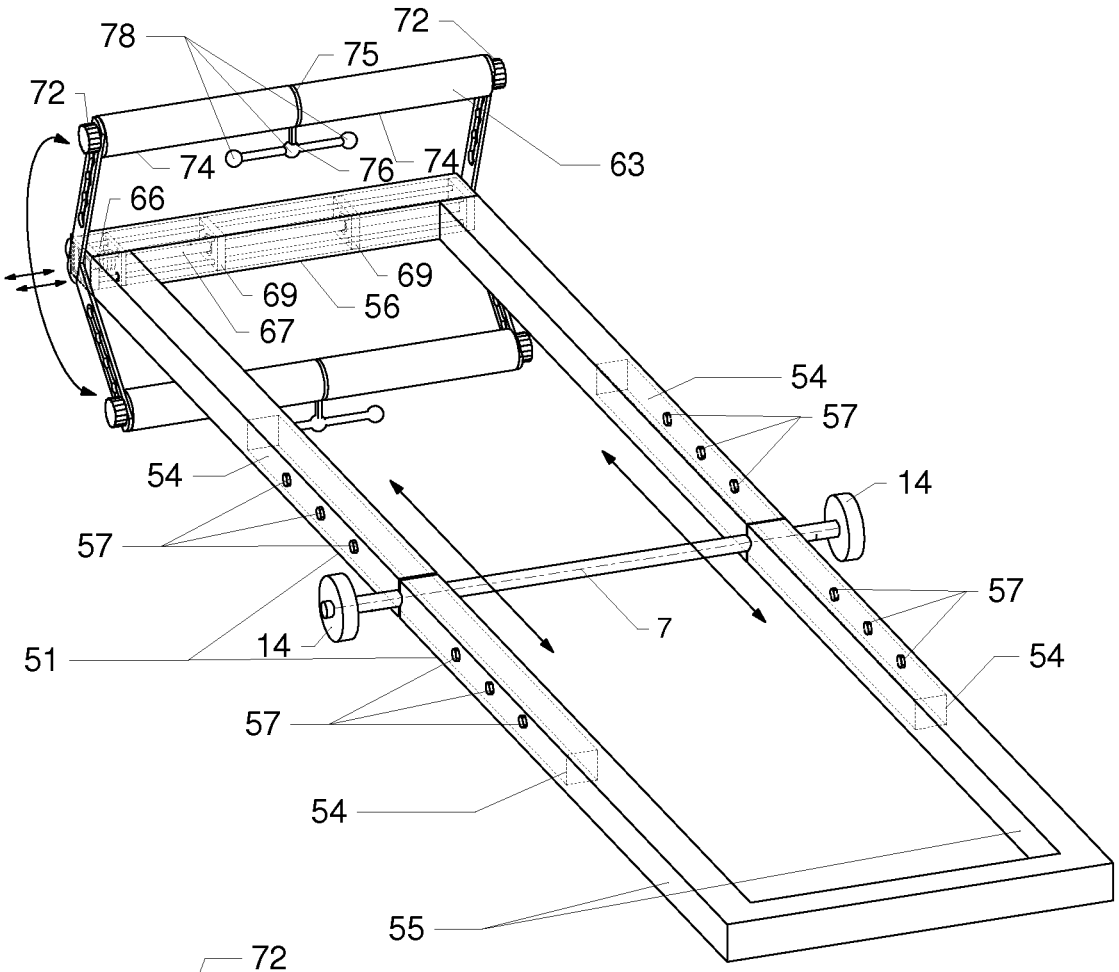
FIG. 9 depicts the supporting structure of the body supporting panel of the device with axle and transverse carrier bar.

FIG. 9 depicts the supporting structure of the body supporting panel of the device with axle and transverse carrier bar. A framework of the bed of the device (51) is consists of three framework parts. The first part of the bed framework (54) consists of two square poles connected with the axle of the device (7) in the middle of the bed framework (51). The second part of the bed framework on the left-hand side of the bed (55) and the third part of the framework on the right-hand side of the bed (56) are inserted into the first part of the bed framework (54) as wider square pipes. Since the square pipes of the second (55) and the third (56) parts of the framework are already connected with the bottom side of the bed (52) of the device and the upper side of the bed (53) of the device, the entire bed of the device (10) on the left-hand and the right-hand sides of the device axle (7) is actually inserted into the first part of the bed framework (54). The first part of the bed framework (54), the second part of the framework (55) and the third part of the framework (56) are connected by means of the screws for connecting bed frameworks (57).

Figure 10:
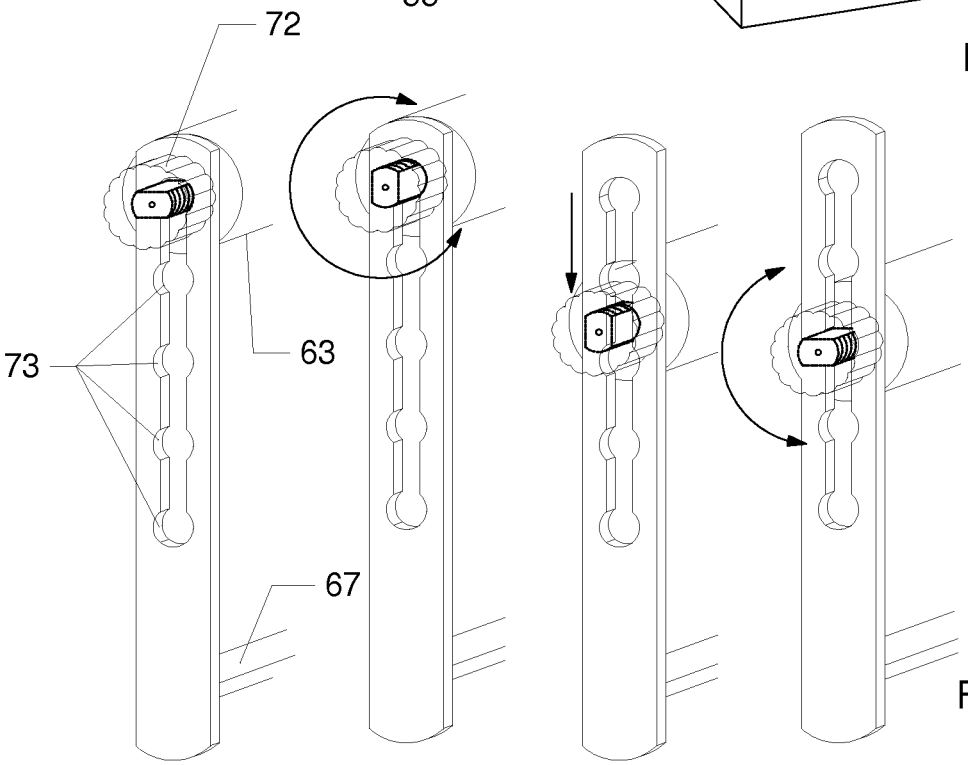
FIG. 10 depicts the option of moving the transverse carrier bar (63) up and down in the connected holes.

FIG. 10 depicts the option of moving the transverse carrier bar (63) up and down in the connected holes. The height setting of the transverse carrier bar (63) is adjustable. The screws (72) on either side of the transverse carrier bar (63) are loosened. The transverse carrier bar (63) is rotated into position so that it can be shifted between the holes (73). When the transverse carrier bar (63) has been adjusted at the desired height, it is secured by the screws (72) on the left and right side of the transverse carrier bar (63). The transverse carrier bar (63) is coated with soft rubber (74), with a notch (75) in the middle for the self-locking rotatable coupling (76).

Figure 11:
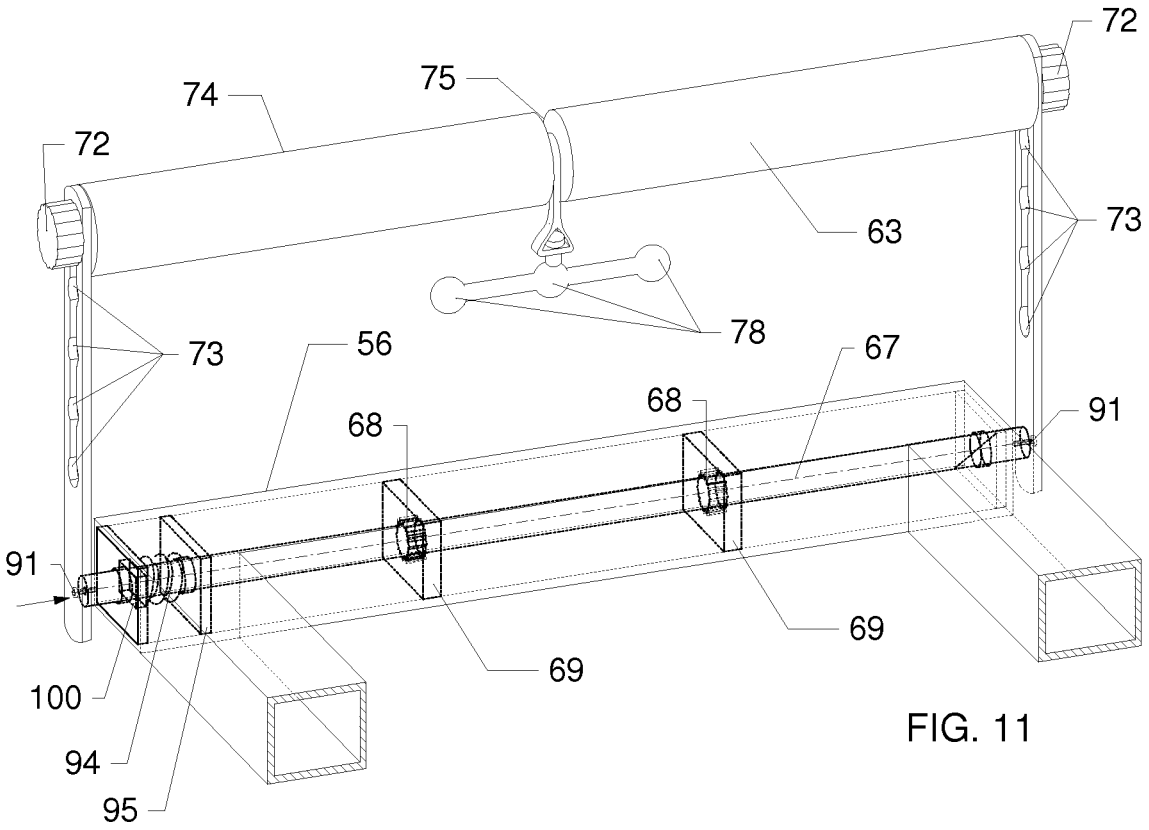
FIG. 11 depicts the mechanism of the transverse carrier bar, which facilitates the rotation of the transverse carrier bar around the axle of the transverse carrier bar, and the self-locking rotatable coupling in the position where the locking pins are in the bushings.
Figure 12:
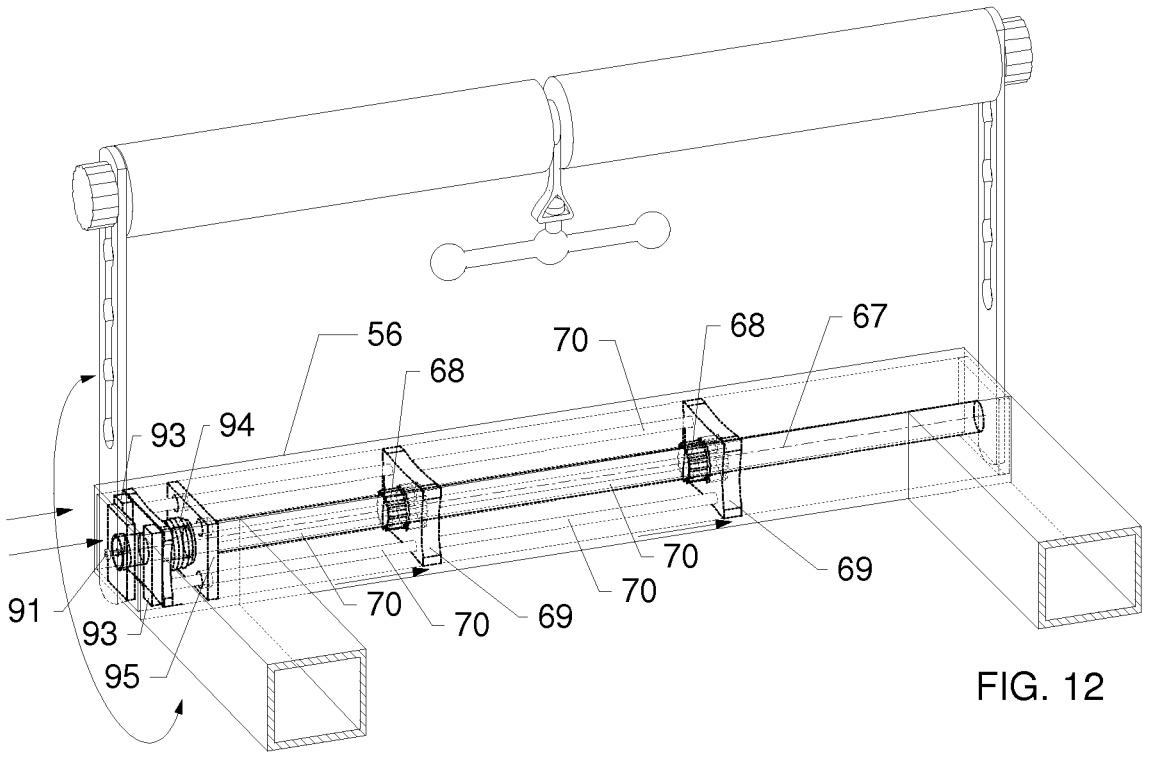
FIG. 12 depicts the mechanism of the transverse carrier bar in the position where the locking pins slide out of the bushings when pressure is applied to the release button.

FIG. 11 depicts the mechanism of the transverse carrier bar (63), which facilitates the rotation of the transverse carrier bar around the axle of the transverse carrier bar, and the self-locking rotatable coupling (76). 31. A transverse carrier bar (63) is connected to the axle of the transverse carrier bar (67), built into the third part of the framework (56) on the edge of the right-hand side of the bed of the device (10). The user can safely move and use the transverse carrier bar (63) on the bottom side of the bed (52) and on the top side of the bed (53). FIG. 11 shows the possibility of rotation of the transverse carrier bar when the axle is moving and the bushes are fixed. FIG. 12 shows the other possibility of rotation of the transverse carrier bar, i.e. when the axle is fixed and the bushes are moving. When the axle is moving and the bushes are fixed, the transverse carrier bar mechanism (66) consists of the transverse carrier bar axle (67), two or more wedges on the axle (68), two or more bushes (69), a framework of the transverse carrier bar mechanism (56) tightly gripping the bushes (69), a screw for fastening the transverse carrier bar (91) onto the transverse carrier bar axle (67), a plate fastened on the axle (100), against which the spring presses when the transverse carrier bar axle (67) is being pushed, a fixed plate (95) in which the spring (94) stops. FIG. 11 shows the transverse carrier bar mechanism when the wedge is in the bush, which ensures a stable position of the transverse carrier bar.

FIG. 12 depicts the mechanism of the transverse carrier bar in the position where the locking pins slide out of the bushings when pressure is applied to the release button. The transversal bar mechanism (66) consists of a transversal bar axle (67), two or more wedges on the axle (68), two or more bushes (69), four bush guides for moving bushes (70), a framework of the transversal bar mechanism (56) tightly gripping the bushes (69), a screw for fastening the transversal bar onto the transversal bar axle (91), a button, a mechanism plate (93) pushing the spring for moving the bushes (94), a plate with holes for guides, pushing the spring onto the plate with holes (95). FIG. 11 shows the transversal bar mechanism when the wedge is in the bush, which ensures a stable position of the transversal bar.

A self-locking rotary coupler (76) can be mounted onto the transversal bar (63) into the notch in the middle of the transversal bar (75) on the one side, while on the other side there are rings (78) on the self-locking rotary coupler (76), into which carabiners (79) are installed for ankle and foot grip (80). The self-locking rotary coupler (76) on the transversal bar (63) on the end of the bed enables the user, during exercises, to turn on the bed on his or her back or stomach or even sideways safely and in a relaxed manner, which enhances the possibility of stretching and exercising the entire body.

Figure 13:
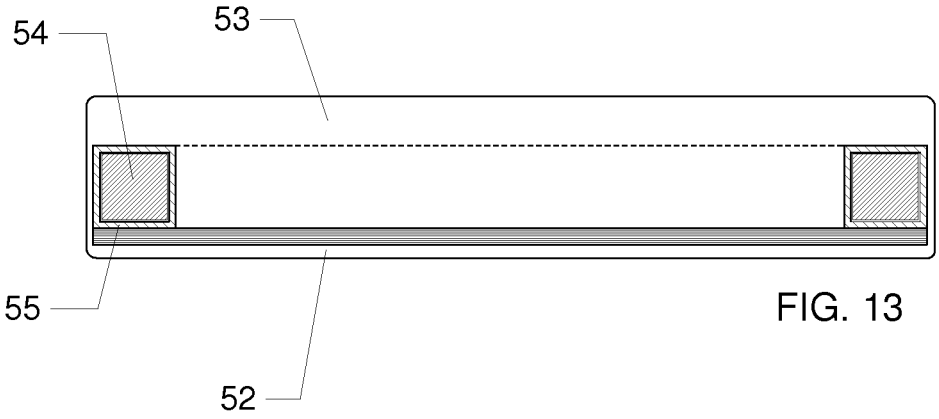
FIG. 13 depicts a cross section of the body supporting panel.

FIG. 13 depicts a cross section of the body supporting panel. A bed of the device (10) is consists of: a framework of the bed of the device (51), a first part of the framework (54), a second part of the framework (55), a bottom side of the bed (52) consisting of a plate coated with foam and microfiber, leatherette or artificial leather and of a top side of the bed (53) which is upholstered.

Figure 14:
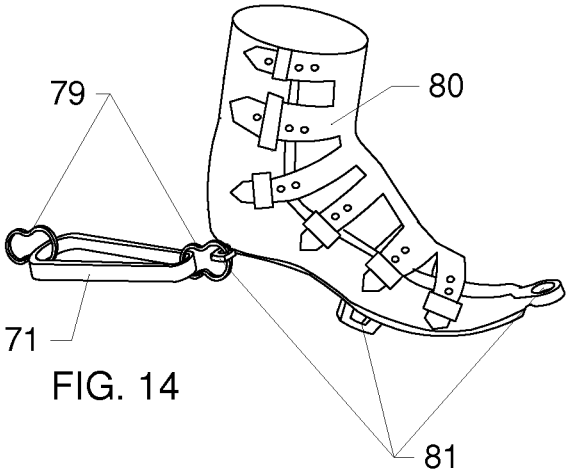
FIG. 14 depicts the foot and ankle support.

FIG. 14 depicts the foot and ankle support. A specially designed ankle and foot grip (80) can be attached by the user by means of a carabiner on the safety belt for legs to the rings of the self-locking rotary coupler (78) on the heel, toes or in the middle of the foot (81).

Figure 15:
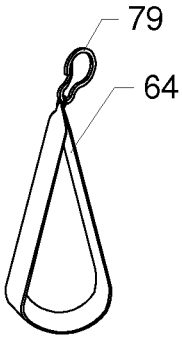
FIG. 15 depicts the hand loop.

FIG. 15 depicts the hand loop. A hand grip (64) can if desired by the user, be installed on the edges of the bed of the device (10) into U clamps (60) or onto the control rudder of the device (8) on the left-hand and the right-hand sides. Safety belts (62) can also be used as hand grips (64). Hand grips (64) and ankle and foot grips (80) are used during stretching and muscle-strengthening exercises.

Figure 16:
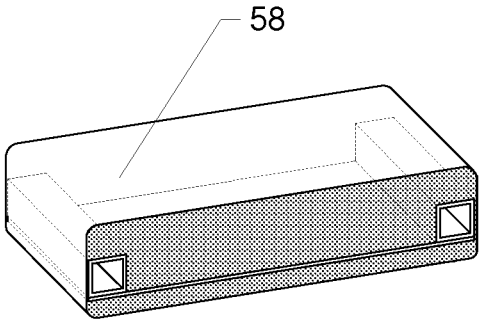
FIG. 16 depicts the extension attachment for the body supporting panel.

FIG. 16 depicts the extension attachment for the body supporting panel. A bed of the device (10) can be extended. In this case the second (55) and the third (56) parts of the bed framework are removed from the first part of the bed framework (54). Then an added bed insert (58) is inserted into the first part of the bed framework (54), whereupon the second (55) and the third (56) framework parts with the bed are inserted and both frameworks are screwed into the first part of the bed framework (54) by means of screws (57).

Figure 17:
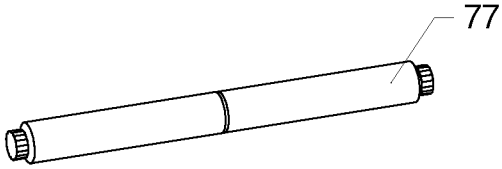
FIG. 17 depicts the additional transverse carrier bar.

FIG. 17 depicts the additional transverse carrier bar. Under the transversal bar (63) user can add or remove an additional transversal bar (77) that is installed for a good foot-grip. The edge on the end of the bed and the safety belt (62) to be placed transversely on the bed of the device (10) can also be used for this purpose. The use of the transversal bar (63) and a self-locking rotary coupler (76) is obligatory when the device is rotating.

Figure 18:
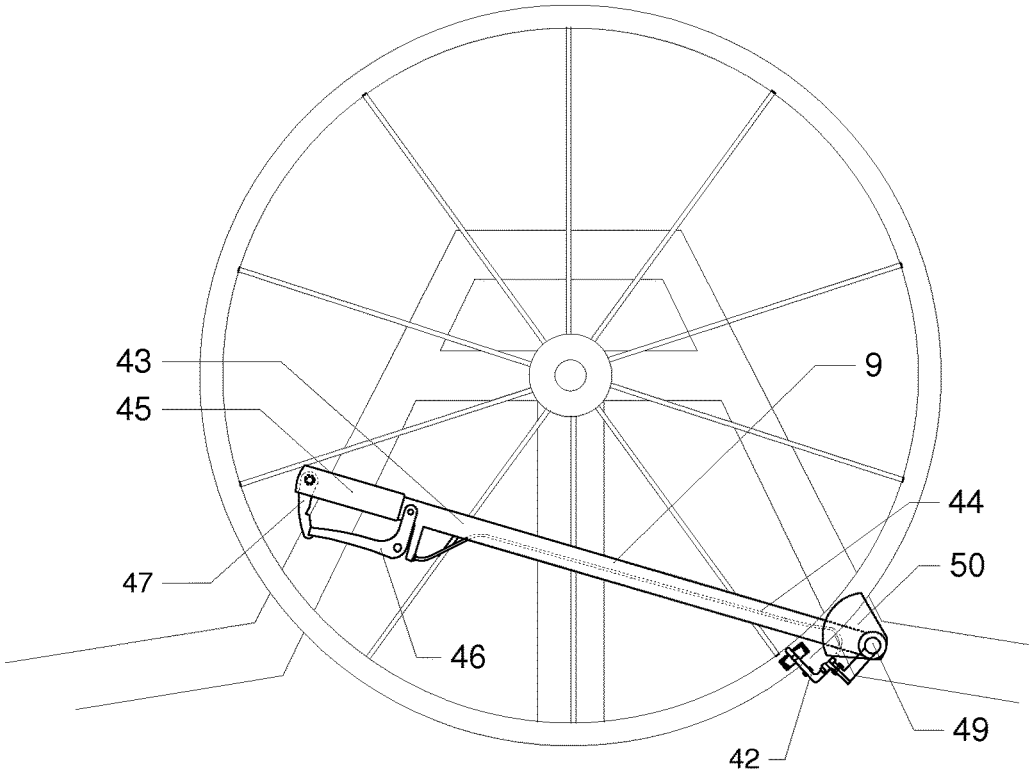
FIG. 18 depicts the lever for blocking the device.

FIG. 18 depicts the lever for blocking the device. A device-locking lever (9) is fastened in the upper right-hand part of the framework (6) and intended for locking the device in a certain position. This part of the device consists of a shoe with two rubber pads (42), a hollow tube (43) of the lever through which a cable runs (44). A handle for locking the device (45) and a brake lever in the handle (46) are to be found at the end of the hollow lever (43). The device-locking lever (9) is on the right-hand side of the upper part of the framework (6), with the possibility of a wide travelling arc of up to 90 degrees. The mobility of the device-locking lever (9) is adjusted by means of a screw (49) and two gaskets (50) located on both sides on the end of the device-locking lever (9).

Figure 19:
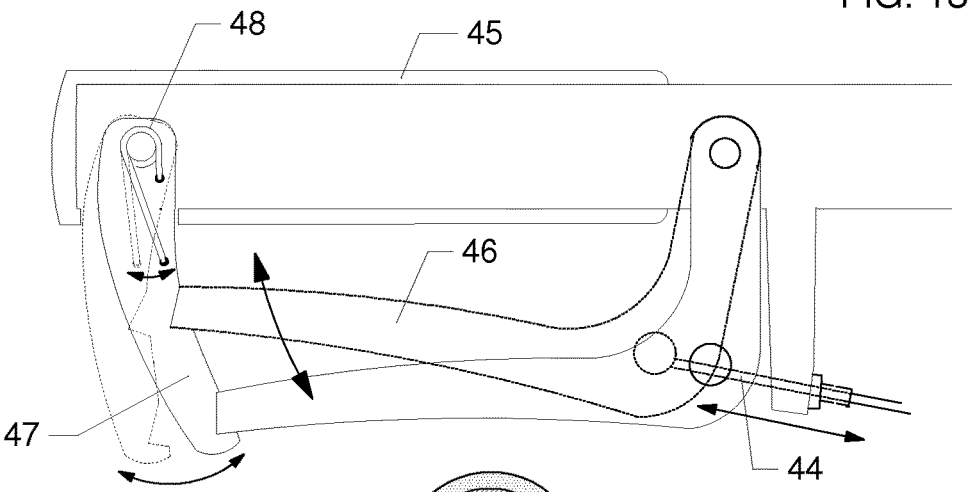
FIG. 19 depicts the handle of the lever for blocking the device.

FIG. 19 depicts the handle of the lever for blocking the device. The handle (45) on the end of the device-locking lever (9) a moving part of the handle (47) with a built-in spring (48) is fixed on the end of the handle (45). The spring in the moving part of the handle (48) pushes the moving part of the handle (47) towards the brake lever (46). When the brake lever (46) is pushed upwards, the cable (44) tightens and the brake lever snaps into the moving part of the handle (47). Thus the rudder (8) of the device is locked. When the moving part of the handle (47) moves to the left, the cable (44) loosens and the brake lever (46) moves to the starting position.

A device-locking handle (45) can also be used for wheelchairs and prams; in respect of the handle, the use for such a purpose requires patent protection.

Figure 20:
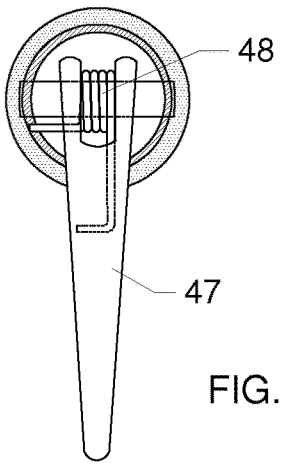
FIG. 20 depicts the crankshaft of the lever and spring.

FIG. 20 depicts the crankshaft of the lever and spring.

Figure 21:
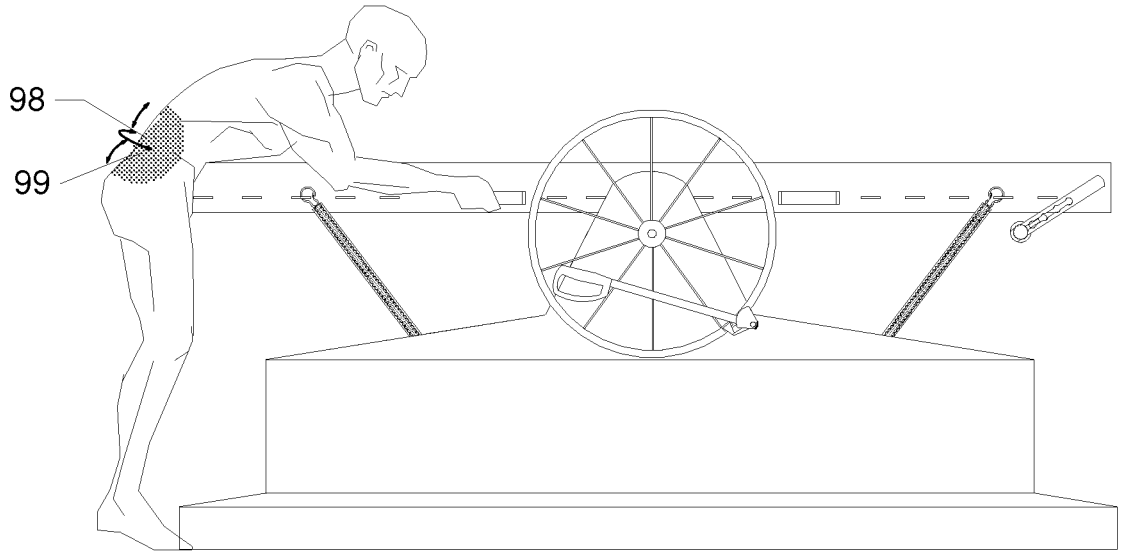
FIG. 21 depicts a person situated by the body supporting panel of the device ready to execute the routine for stretching their back, exercising their knees and feet and massaging their internal organs.
Figure 22:
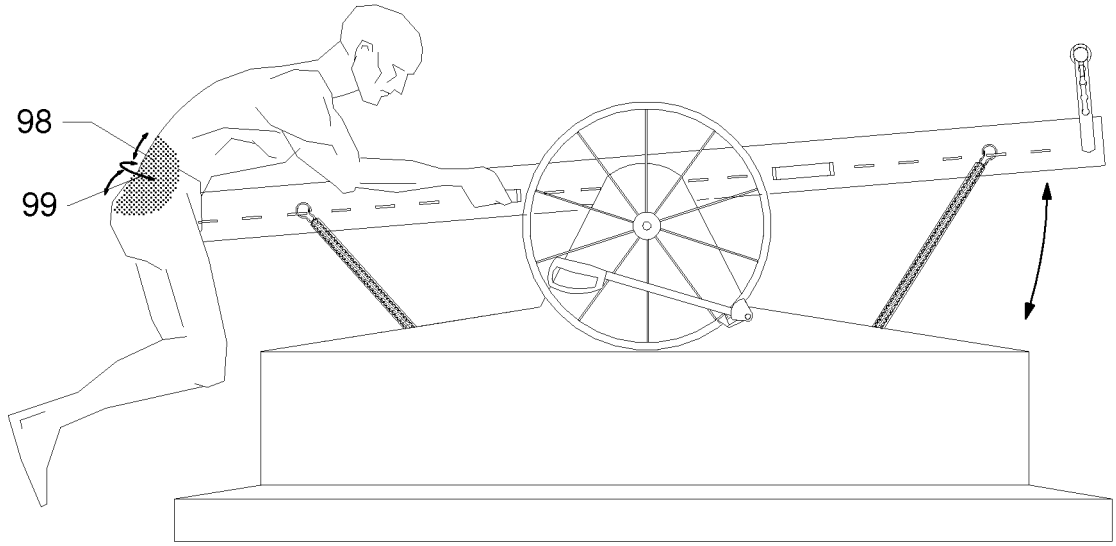
FIG. 22 depicts a person on the body supporting panel, stretching the sacral and lumbar area of their back with bent knees, by utilizing the weight of the lower part of their body.

FIG. 21 depicts a person situated by the body supporting panel of the device ready to execute the routine for stretching their back, exercising their knees and feet and massaging their internal organs. FIG. 22 depicts a person on the body supporting panel, stretching the sacral and lumbar area of their back with bent knees, by utilizing the weight of the lower part of their body. The device for general and sports physiotherapy and its use is possible to change the height of the device with regard to the selected exercises, taking into consideration all medical and other specific features of the user. It can be used when electric jacks (30) are at the lowest point. In this position the device is recommended for the elderly and frail persons during the stretching of the body and limbs. The device with electric jacks (30) can also be lifted and the bed of the device (10) rotates around its axis which is suitable for more demanding users.

The device for general and sports physiotherapy and its use is used for relaxing cramped muscles and relieving the pressure between the vertebrae, particularly in the lumbar spine (98) and in the small of the back (99) when electric jacks (30) are at the lowest point. The use of the device in this position includes the following activities:

First of all the therapist prepares the device for therapy. The therapist adjusts the height of the device down to the device's lowest position, or respectively, to the most comfortable position for the user. The decision to either lock the device or enable the bed to move upwards and downwards is taken on the basis of the user's health condition.

If the therapist does not lock the device, he or she checks whether the rocking of the bed upwards and downwards is appropriately regulated by springs (61) linking the bed of the device (10) and the bottom part of the framework (4), with respect to the user's weight.

When the user comes to the bed, he or she leans forward so as to press with his or her stomach against the edge of the bed. The feet are on the floor and the knees alternate between stretching and bending. In this position and the user's movement, the pressure in the abdominal cavity alternately increases and decreases, acting perpendicularly in the direction of the lumbar spine (98) and the small of the back (99). In this way muscles and joints in the lumbar spine and the small of the back relax in all directions, in the direction of the spine upwards and downwards, and at the same time in the direction from the spine to the left and to the right sides. This manner of relaxing muscles and joints of the spine in the lumbar spine (98) and the small of the back (99) during the exercise in which there is a controlled rocking of the device upwards and downwards is innovative, offering new possibilities for preventive medicine and for the protection of the spine and its therapy.

In this exercise it is the user's choice to decide on the weight with which to lean with the abdominal cavity on the edge of the bed and how much to bend the spine, while the bed is rocking upwards and downwards. The user may use both legs or only one leg, while burdening the other leg only as much as permissible for him or her, and gradually increase the load. This device enables the user and the therapist to select either the passive or active functioning of muscles and joints, always taking into consideration the permissible loads for the user.

The device for general and sports physiotherapy and its use enables exercises involving the stretching and contracting of muscles for the protection of the spine which are recommended by the medical profession. The experience that orthopedists will gain with this device will show what intensity of exercise as claimed in claim 39 is suitable for a preventive spine protection programme, for spine, hips, knee, ankle and foot therapies in cases when it is recommended to undergo a simultaneous therapy for the spine and lower limbs and in cases of countering the effects of injuries and illness, e.g. after a stroke.

Figure 23:
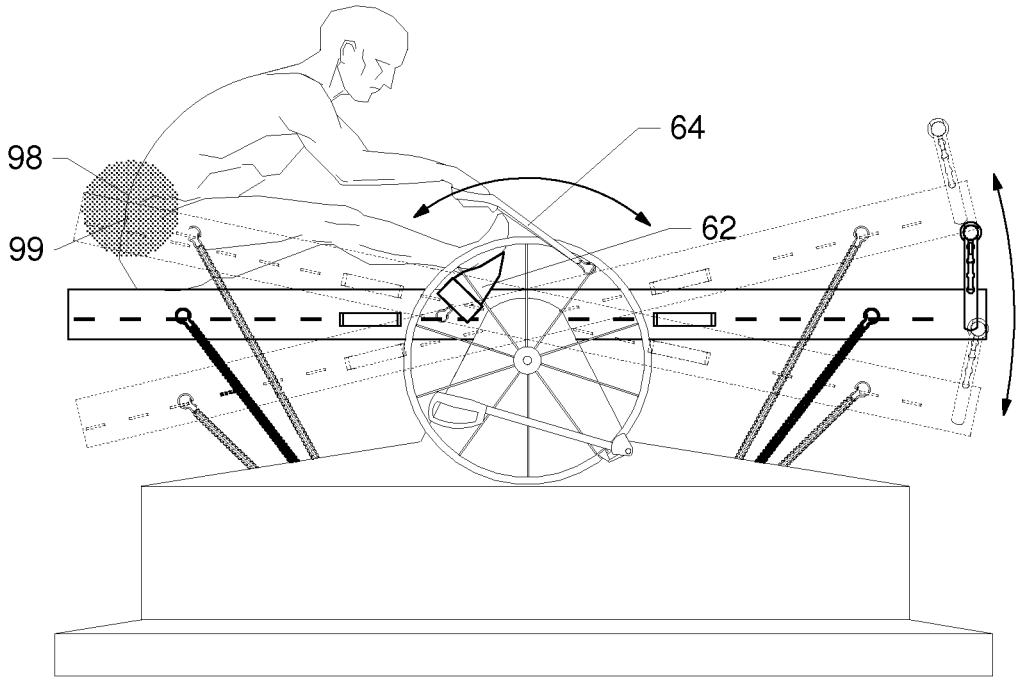
FIG. 23 depicts the stretching and contraction of the muscles of the lumbar and sacral regions of the spine by means of an exercise similar to rowing.

FIG. 23 depicts the stretching and contraction of the muscles of the lumbar and sacral regions of the spine by means of an exercise similar to rowing. The device for general and sports physiotherapy and its use enables the performance of exercises involving the movement of arms and legs and of the entire body and resembles the movements of the body of a rower. This exercise can be performed by two persons at the same time. The user uses springs (61) to regulate the rocking on the device. Four or more springs (61) can be used. This exercise is performed with the device at its lowest point and with the springs (61) attached to the device. The user is sitting on the bed of the device (10) and performs the exercise by pulling towards him or her both rudders of the device (8), while his or her legs lean against the safety belt (62). The user can also attach hand grips (64) to the rudders of the device (8), which facilitates the performance of this exercise. This exercise stretches and contracts the back muscles in the area of the lumbar spine (98) and the small of the back (99), strengthening at the same time the abdominal muscles and the arm and leg muscles. In the exercise for strengthening the abdominal muscles, the user sticks his or her feet behind the transversal bar (63) or the safety belt (62), and then lifts himself and lowers himself using different inclination angles of the bed of the device (10).

Figure 24:
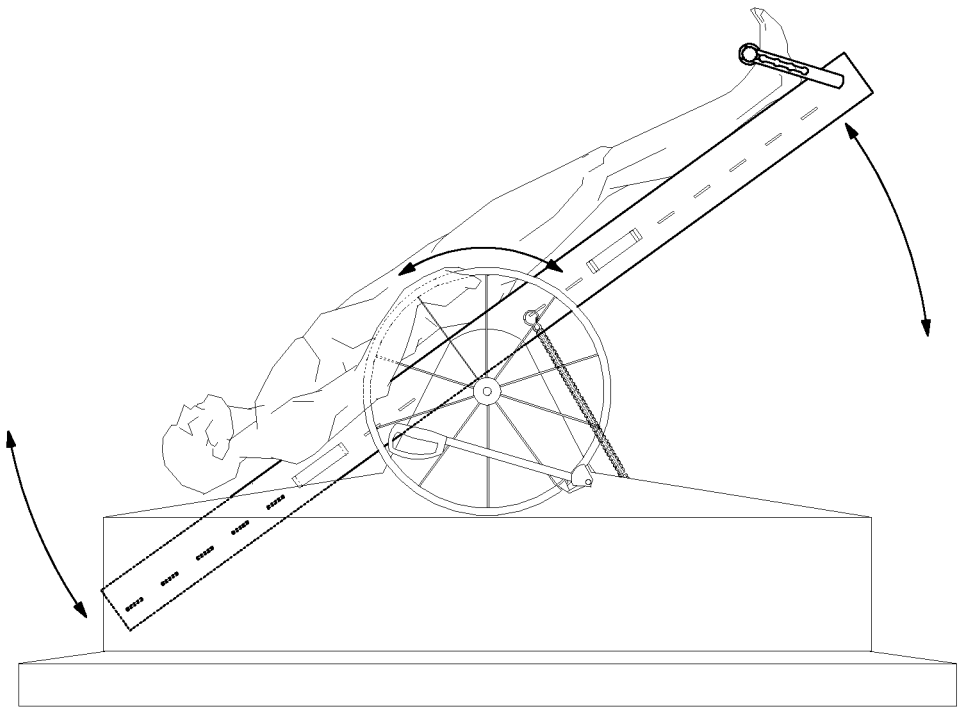
FIG. 24 depicts the manual adjustment of the tilt of the body supporting panel by raising or lowering the head area by means of the user's rotating both control devices of the apparatus. The figure depicts the position of the user's body with the feet hooked under the transverse carrier bar.

FIG. 24 depicts the manual adjustment of the tilt of the body supporting panel by raising or lowering the head area by means of the user's rotating both control devices of the apparatus. The figure depicts the position of the user's body with the feet hooked under the transverse carrier bar. The device for general and sports physiotherapy and its use can manually steer it and stop it at any inclination angle of the bed. These operations are carried out by means of the rudder of the device (8), while the device can be locked by means of a locking lever of the device (9) in the required position. Through the selection of inclination angles of the bed, the device enables gradual loads in the stretching of muscles and joints. When inclination angles of the bed are smaller, the bed carries the weight of the body and the load on muscles and joints is small. At higher inclination angles of the bed, the load on muscles and joints is considerably greater since they carry the weight of the entire body.

Figure 25:
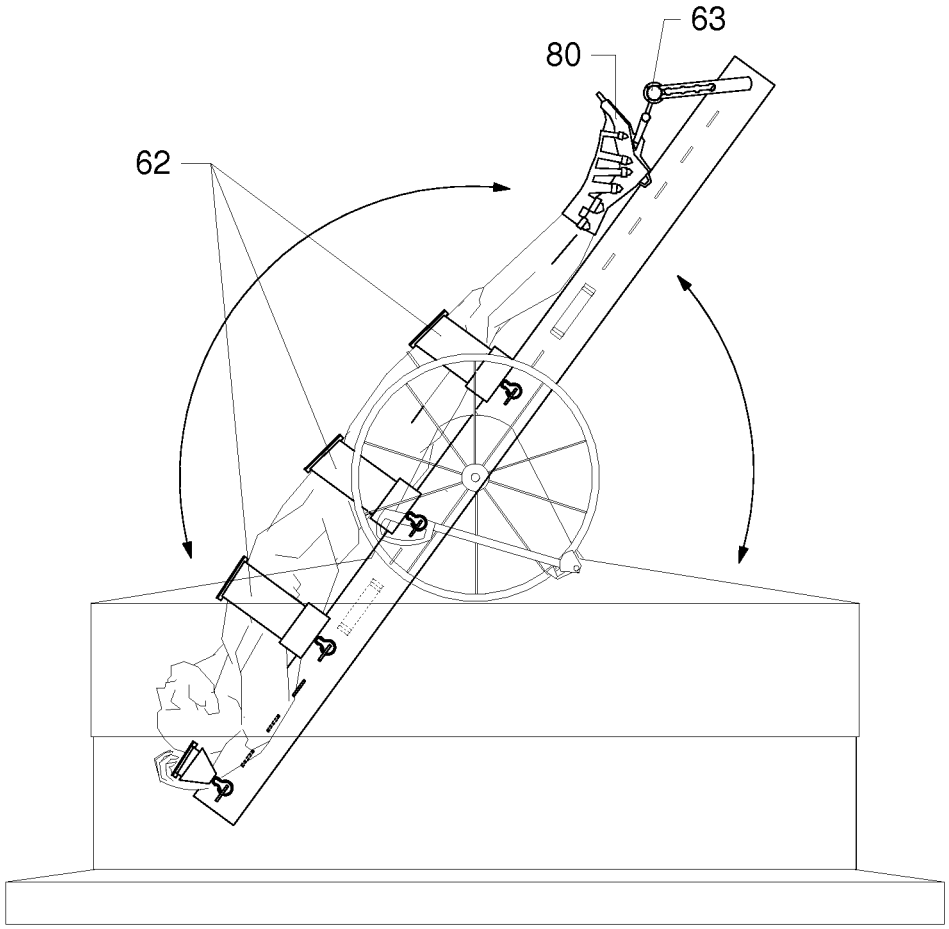
FIG. 25 depicts a full-body stretch from the feet to the hands and vice versa from the hands to the feet. For execution of this exercise the user is buckled in using the safety belts and additionally secured by the supports for the ankles and feet attached to the transverse carrier bar, while the user holds onto the safety belt.

FIG. 25 depicts a full-body stretch from the feet to the hands and vice versa from the hands to the feet. For execution of this exercise the user is buckled in using the safety belts and additionally secured by the supports for the ankles and feet attached to the transverse carrier bar, while the user holds onto the safety belt. The device for general and sports physiotherapy and its use the device offers, under conditions of lifted electric jacks (30) and a rotating bed, many possibilities of selecting exercises, which are otherwise performed on other devices, for the stretching and contracting of muscles and joints of the entire body, through additional selection of different possible inclination angles of the bed of the device (10). The device with raised electric jacks (30) is intended for the use by users active in sports. The user can activate the device by an electronic transmitter (27) and then the user rotates to one or the other side when the device is lifted. The user can stop the device electronically at any inclination angle of the bed. During this movement the user can lie on the back, stomach or on either side of the body for which the user must be safely belted onto the device. With this movement, the user stretches his or her entire body to a maximum, i.e. alternately from the direction of the arms when the body is upright on the device down to the feet, and from the feet down to the head when the body is turned upside down. The above movement of the body also has an exceptional impact on the functioning of internal organs.

Figure 26:
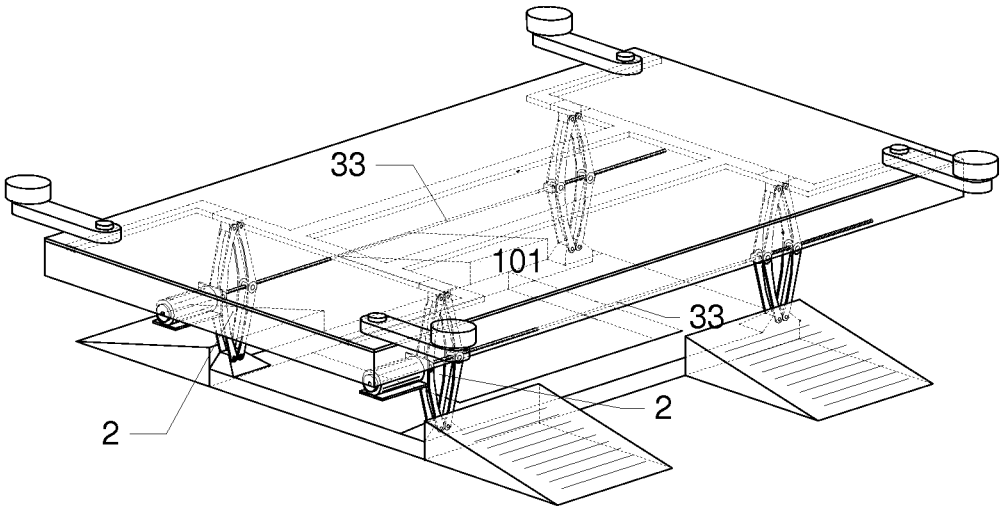
FIG. 26 depicts an alternate use of the lift technology used in the device for use as an electric jack for tyre service.

FIG. 26 shows the electric jack for tyre service (101). The mechanism for lifting and lowering the device for general and sports physiotherapy can also be used as an electric jack for tyre service. This mechanism onto which the platform for the positioning of the car is mounted is competitive with the pneumatic lift for car tyre service in terms of reliability and durability of use, as well as in terms of the costs of manufacture and maintenance. The mechanism is an essential part of the electric jack for tyre service and requires patent protection.

What is claimed is:

1. A device for physiotherapy comprising:

a frame, said frame comprising a left side, said left side being located to the left of a longitudinal axis of the device, having an upper left side and a lower left side, a right side, said right side being located to the right of a longitudinal axis of the device, having an upper right side and a lower right side, a transverse support connection, a left side control device, a right side control device, and a device blocking lever, said device blocking lever being located on a side of the device;

a driving mechanism, said driving mechanism being situated in the upper left side of the frame and the upper right side of the frame, and having a main axle;

a mechanism for raising and lowering the device, said raising and lowering mechanism being situated in the lower left side of the frame and the lower right side of the frame;

electrical and electronic equipment for raising and lowering the device;

a body supporting panel, said body supporting panel being secured by padded springs;

a transversal bar; and an ankle and foot grip.

2. The device for physiotherapy of claim 1, wherein the driving mechanism further comprises a housing, a ball bearing housing, a small cogwheel located on the main axle, a large cogwheel located on a secondary axle, an asynchronous electric motor with a reduction worm gear unit, and a clutch and a belt drive.

3. The device for physiotherapy of claim 2, wherein the driving mechanism enables manual operation of the device when idling, and a steering mechanism of the device is located on the left and the right sides of the frame of the device.

4. The device for physiotherapy of claim 2, wherein the electrical and electronic equipment further comprises a control cubicle, a modem for electronic control of the device, an emergency stop button, a cut-out, contactors, a power supply, a switch for the reduction worm gear unit on the top of the device, and an electronic transmitter.

5. The device for physiotherapy of claim 1, wherein the lower left side and the lower right side of the frame allow electric lifting and lowering of the device, with the mechanism for raising and lowering the device comprising four electric jacks and two identical electric motors and reduction worm gear units with limit switches, with each electric motor driving two jacks that are linked with a common axle.

6. The device for physiotherapy of claim 1, wherein the device blocking lever is comprised of a shoe with two rubber pads, a hollow tube through which a cable runs, a handle for locking the device, and a brake lever having a wide travelling arc of up to 90 degrees.

7. The device for physiotherapy of claim 6, wherein the device blocking lever contains a moving handle with a built-in spring fixed on an end of the handle.

8. The device for physiotherapy of claim 1, further comprising:

a transverse carrier bar, having an axle;

two or more wedges on the transverse carrier bar axle;

two or more bushings;

a framework of the transverse carrier bar gripping the bushings;

a screw for fastening the transverse carrier bar onto the transverse carrier bar axle;

a plate fastened on the transverse carrier bar axle, against which a spring presses when the transverse carrier bar axle is pushed; and a fixed plate against which the spring stops.

9. The device for physiotherapy of claim 1, wherein the ankle and foot grip is capable of being attached to a user by means of a carabiner on a safety belt.

10. The device for physiotherapy of claim 1, wherein said padded springs are adapted to retain the body supporting panel at an inclination angle, said padded springs being inserted into U clamps located on edges of the body supporting panel and into inner edges of the lower left side of the frame and the lower right side of the frame.

11. The device for physiotherapy of claim 10, wherein a user can manually steer and stop the body supporting panel at any inclination angle by using a rudder with the use of said padded springs, whereby the device can be locked in the required position by means of the device blocking lever.

* * * * *